US009281143B2

(12) United States Patent
Charollais

(10) Patent No.: US 9,281,143 B2
(45) Date of Patent: Mar. 8, 2016

(54) LIMIT SWITCH

(71) Applicant: SCHNEIDER ELECTRIC INDUSTRIES SAS, Rueil Malmaison (FR)

(72) Inventor: Nicolas Charollais, Soyaux (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 49 days.

(21) Appl. No.: 14/339,892

(22) Filed: Jul. 24, 2014

(65) Prior Publication Data

US 2015/0075952 A1 Mar. 19, 2015

(30) Foreign Application Priority Data

Sep. 19, 2013 (FR) ..... 13 59015

(51) Int. Cl.

| | |
|---|---|
| ***H01H 3/16*** | (2006.01) |
| ***H01H 21/02*** | (2006.01) |
| ***H01H 11/00*** | (2006.01) |
| ***H01H 21/28*** | (2006.01) |

(52) U.S. Cl.

CPC ..... *H01H 21/02* (2013.01); *H01H 3/16* (2013.01); *H01H 11/0006* (2013.01); *H01H 21/285* (2013.01); *H01H 2221/032* (2013.01)

(58) Field of Classification Search

CPC ..... H01H 21/28; H01H 21/285

USPC ..... 200/47

See application file for complete search history.

(56) References Cited

U.S. PATENT DOCUMENTS

| | | | | |
|---|---|---|---|---|
| 3,578,932 | A * | 5/1971 | Holmes | H01H 11/0006 200/302.1 |
| 6,627,827 | B2 * | 9/2003 | Kiong Low | H01H 21/28 200/47 |
| 8,816,226 | B2 * | 8/2014 | Zhou | H01H 21/285 200/47 |
| 2003/0010614 | A1 | 1/2003 | Takenaka et al. | |

FOREIGN PATENT DOCUMENTS

| | | |
|---|---|---|
| EP | 1 276 124 A2 | 1/2003 |
| EP | 1 876 616 A2 | 1/2008 |

OTHER PUBLICATIONS

French Preliminary Search Report issued May 26, 2014, in French Application No. 13 59015 filed Sep. 19, 2013 (with Written Opinion and English Translation).

French Preliminary Search Report issued May 26, 2014, in French Application No. 13 59015 filed Sep. 19, 2013 (with Written Opinion and English Translation of Categories of Cited Documents).

* cited by examiner

*Primary Examiner* — Vanessa Girardi

(74) *Attorney, Agent, or Firm* — Oblon, McClelland, Maier & Neustadt, L.L.P.

(57) ABSTRACT

The invention relates to a limit switch comprising:

a body (1) produced along a main axis (X) and containing a switching device, a head (2) that is removable and orientable with respect to the body (1) so that it can adopt several distinct angular positions about the main axis (X), said head (2) comprising actuating means arranged to act on the switching device, fixing means for fixing the limit switch to a support (S), the fixing means being arranged on the head (2) of the limit switch, the head (2) having at least two separate bearing planes, said fixing means being arranged to fix the head so that it bears against the support via one or other of its two bearing planes.

10 Claims, 4 Drawing Sheets

LIMIT SWITCH

TECHNICAL FIELD OF THE INVENTION

The present invention relates to the field of sensors, more particularly sensors of the mechanical limit switch type.

PRIOR ART

As is known, a limit switch comprises a body, generally of parallelepipedal shape, and a removable and orientable head fixed to the body. The body comprises a switching device and the head bears actuating means arranged to collaborate with the switching device. The actuating means comprise an actuating member such as, for example, a lever or a press rod. Movement of an object is detected by mechanical actuation of the actuating member. Patents FR2134814 and U.S. Pat. No. 4,133,991 describe a limit switch as is known in the prior art. Applications EP1276124A2 and EP1876616A2 also describe prior-art solutions.

At the present time, a limit switch is fixed to a support (or chassis) and positioned in such a way that its actuating member lies in the path of the object the movement of which is to be detected. Contact between the object and the head gives rise to high stresses on the head. These stresses sometimes exceed manufacturer recommendations. Thus the head may have to withstand loadings ranging up to 50 N in the press rod version and 0.50 Nm in the lever version.

In order to meet the requirements of modularity and of keeping the head orientable with respect to the body, which requirements make the device suited to all supports, the body and the head need to be produced as two separate components. However, this two-part design weakens the limit switch as the head may break with respect to the body when the stresses applied are too high or unsuitable.

It is an object of the invention to propose a limit switch that has a design capable of withstanding the high stresses that are likely to be applied to its head.

SUMMARY OF THE INVENTION

This object is achieved by a limit switch comprising:

- a body produced along a main axis and containing a switching device,
- a head that is removable and orientable with respect to the body so that it can adopt several distinct angular positions about the main axis, said head comprising actuating means arranged to act on the switching device,
- fixing means for fixing the limit switch to a support,
- the fixing means being arranged only on the head of the limit switch,
- the head having at least two separate bearing planes, said fixing means being arranged to fix the head so that it bears against the support via one or other of its two bearing planes.

According to one particular feature, the fixing means comprise:

- two first passages produced on the head in a first transverse direction and two second passages produced on the head in a second transverse direction, distinct from the first transverse direction,
- fixing elements arranged to become inserted in the two first passages so as to fix the head so that it bears against the support via its first bearing plane or so as to become inserted in the two second passages so as to fix the head so that it bears against the support via its second bearing plane.

According to another particular feature, the first passages comprise grooves produced on the head at right angles to the main axis.

According to another particular feature, the second passages comprise orifices produced on the head at right angles to the main axis.

According to another particular feature, the fixing elements comprise two screws each of which becomes inserted in one of the two first passages or in one of the two second passages.

According to another particular feature, the two screws are joined together by a spacer.

According to another particular feature, the fixing elements comprise a staple having two free ends each of which becomes inserted in one of the two first passages or in one of the two second passages.

According to another particular feature, the actuating means comprise an actuating member formed of a pivoting lever, of an axially moveable press rod or of a flexible stem.

According to another particular feature, the head and the body comprise complementary positioning elements arranged to allow the head to adopt said several distinct angular positions with respect to the body.

According to another particular feature, the switching device is fixed to the head.

BRIEF DESCRIPTION OF THE FIGURES

Other features and advantages will become apparent from the detailed description which follows with reference to the appended drawings in which.

DETAILED DESCRIPTION OF AT LEAST ONE EMBODIMENT

Figure 9:
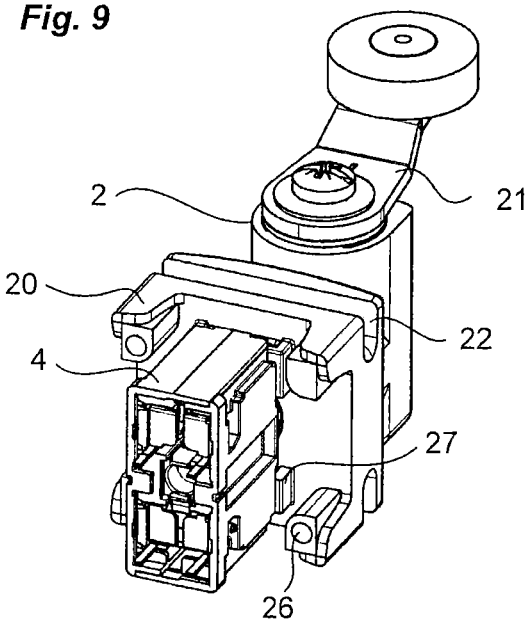
FIG. 9 depicts the head of the limit switch of the invention, to which head the switching device is fixed.

The invention relates to a mechanical limit switch. A limit switch, as depicted in the appended figures, comprises a body 1, preferably of parallelepipedal shape. The body thus comprises a top face, a bottom face and four lateral faces, which are defined with respect to a main axis (X). For preference, the cross section of the body 1 is of square shape. On the bottom face, the limit switch comprises an output connector 10 intended to be connected to a cable. The limit switch also comprises a head 2 attached to the top face of the body 1. The head 2 is removable with respect to the body 1. The body and the head comprise complementary positioning and assembling elements. The positioning elements comprise for example four studs 20 produced on the head transversely to the plane of assembly and arranged so as to collaborate with four complementary recesses produced on the top face of the body 1 of the switch. The assembling elements comprise for example screws 3 which are inserted via the bottom face of the body 1 and pass in the axial direction through the body, the end of each screw being housed in an orifice 26 belonging to the head 2 (FIG. 9). The assembly screws 3 pass through the body 1 in the axial direction, for example along two opposite lateral edge corners of said body 1.

In a known way, the body 1 contains an electrical switching device 4 (FIG. 9) and the head 2 comprises actuating means (not visible in the figures) arranged to collaborate with the switching device 4. As depicted in FIG. 9, the switching device 4 is first of all fixed to the head 2 before being covered by the body 1. Special-purpose catching means 27 are provided underneath the head 2 to catch onto the switching device 4. The actuating means comprise an actuating member such as, for example, a lever 21, a press rod or a flexible stem that can be actuated mechanically by the movement of an object. The movement of the actuating member leads to a change in state of the switching device. An electrical signal is transmitted by the switch when the switching device 4 is in the closed state. Depending on the configuration of the limit switch (normally open or normally closed), the electrical signal will be transmitted when the actuating member is in the rest position or in the actuated position. In the appended figures, the actuating member is made up of a lever 21 which can be made to turn by an object. This lever 21 is fixed to an axle housed in the head and perpendicular to the main axis. In general, a cam mechanism is arranged inside the head 2 to convert the rotational movement of the axle into an axial translational movement of a press rod, which translational movement controls the switching device 4. As the workings of a limit switch are widely known, they will not be described further in detail.

In a known way, the head 2 is removable with respect to the body 1 by unscrewing the assembly screws 3. The head 2 can thus easily be replaced. Moreover, the symmetric configuration of the body 1 and of the positioning elements (studs 20 and complementary recesses) allows the head 2 to adopt various angular positions about the main axis (X). As there are four positioning elements, arranged in a square, the head can thus adopt four separate angular positions about the main axis (X), which positions are offset from one another by an angle of 90°. Of course, a greater number of positioning elements offset from one another by a constant spacing would allow the head to adopt more than four separate angular positions.

According to the invention, the switch is fixed to a support S (or chassis) by the head 2 alone. According to the invention, the limit switch comprises fixing means arranged so as to fix the switch to the support S by its head alone. The body 1 is therefore free of any means of fixing to the support. The fixing means may be varied. Examples are given in the appended figures and described hereinbelow.

Figure 1:
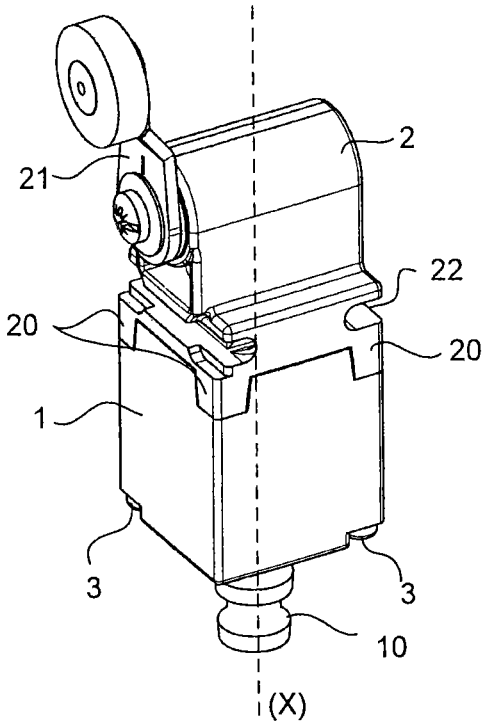
FIGS. 1 to 6 depict the limit switch of the invention in various configurations.
Figure 2:
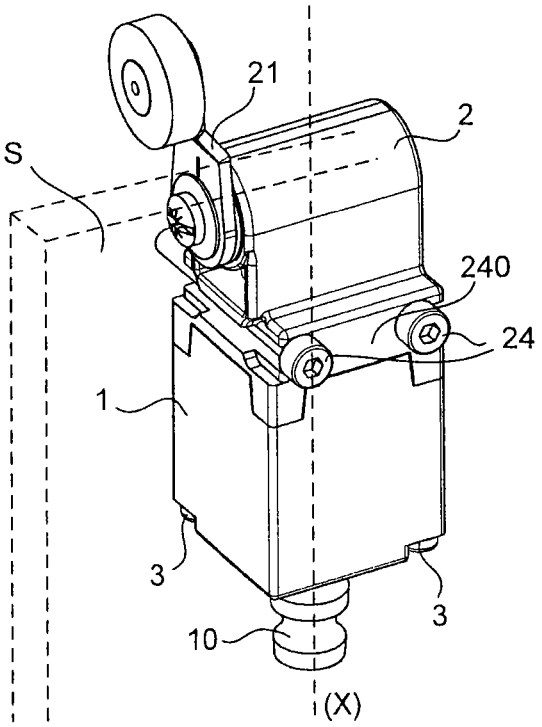
Figure 3:
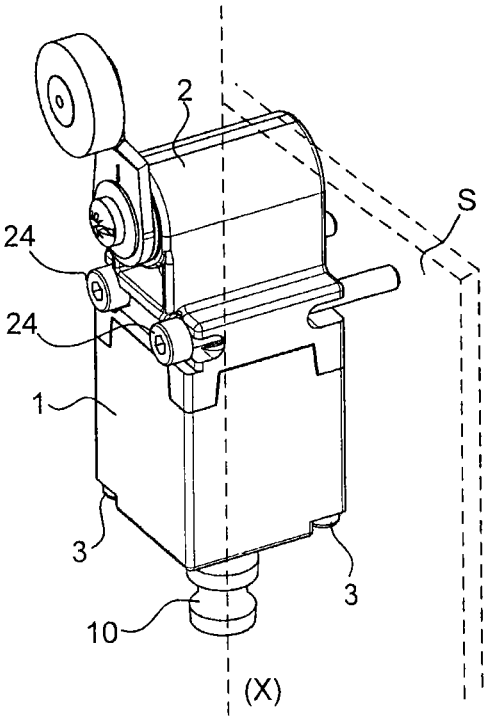
Figure 4:
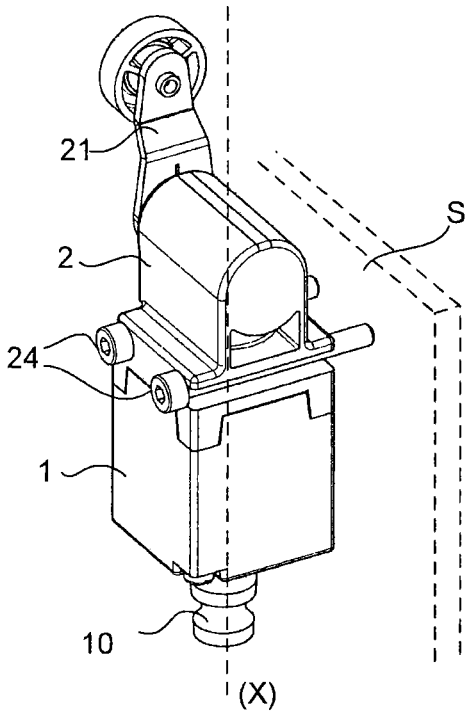

According to the invention, the head 2 has at least two distinct bearing planes and said fixing means are arranged so as to fix the head 2 so that it bears against the support S via one or other of its two bearing planes. In FIGS. 2 and 3, the head 2 is oriented in the same way with respect to the body 1. In FIG. 2, the limit switch is intended to be fixed to the support via a first bearing plane and in FIG. 3, the limit switch is intended to be fixed to the support via a second bearing plane, distinct from the first bearing plane. For preference, the fixing means are arranged so as to allow the head to be fixed via four distinct bearing planes. Said bearing planes are defined by the shape of the cross section of the head. In the appended figures, because the cross section forms a quadrilateral, the head thus has four distinct bearing planes, offset from one another by 90°.

According to the invention, the fixing means comprise transverse passages produced on the head and fixing elements which become inserted in said passages in order to assemble the head 2 on the support S. In order to be able to fix using said two bearing planes, first passages are produced in a first transverse direction at right angles to the first bearing plane, and second passages are produced in a second transverse direction at right angles to the second bearing plane.

Figure 7A:
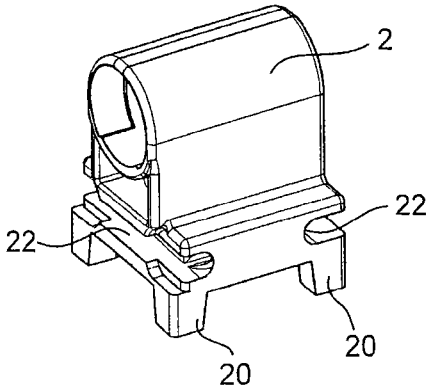
FIGS. 7A to 7C depict the head of the limit switch of the invention according to a first embodiment.
Figure 7B:
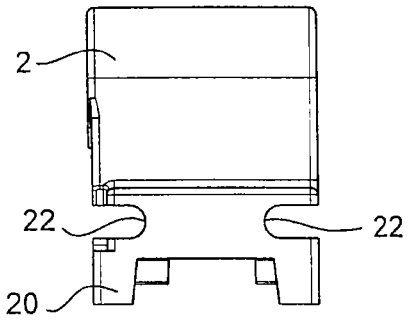
Figure 7C:
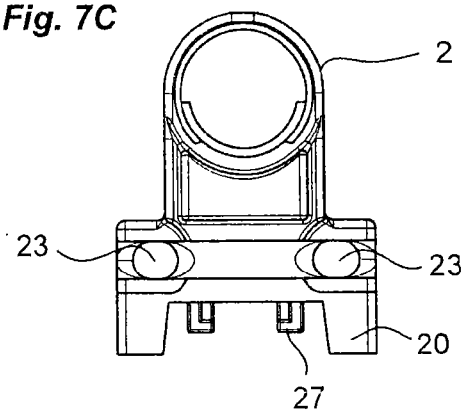
Figure 8A:
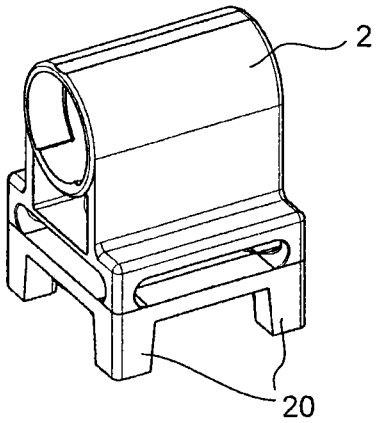
FIGS. 8A to 8C depict the head of the limit switch of the invention according to a second embodiment.
Figure 8B:
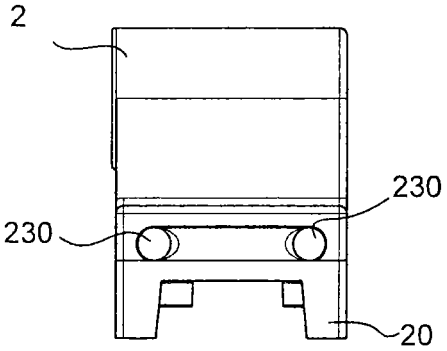
Figure 8C:
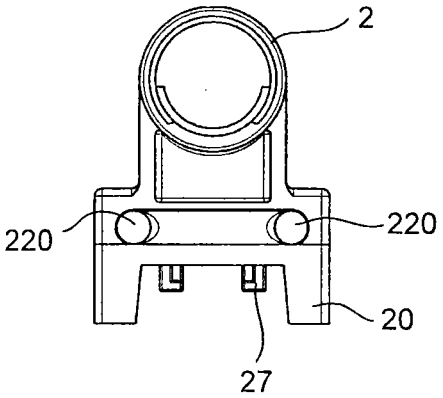

As depicted in FIGS. 7A to 7C, the first passages consist, for example, of two grooves 22 which are parallel and symmetric with respect to the main axis. The second passages consist of two orifices 23 which are parallel and symmetric with respect to the main axis (X). The two orifices 23 are thus pierced along the two other parallel sides of the head. In an alternative form of embodiment depicted in FIGS. 8A to 8C, the first passages consist of two parallel and symmetric orifices 220, replacing the two grooves 22. The second passages also consist of two orifices 230 which are parallel and symmetric with respect to the main axis (X).

Figure 5:
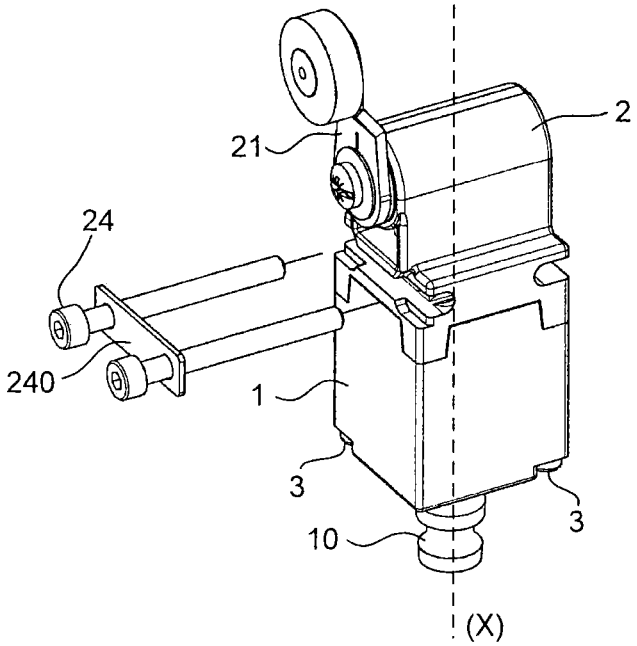
Figure 6:
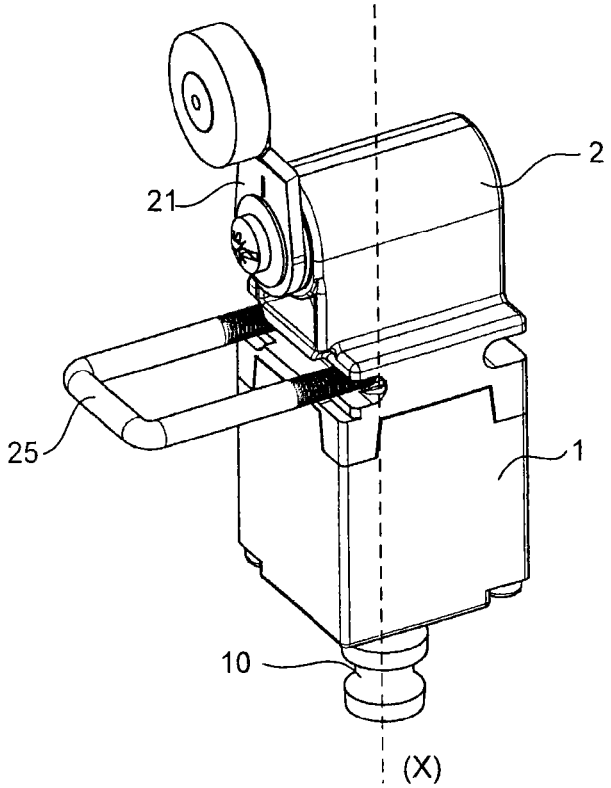

The fixing means also comprise fixing elements such as, for example, two screws 24, which are either independent or joined together, or a staple 25 having two free ends, said fixing elements being designed to become inserted in the first passages or the second passages of the head with a view to fixing the limit switch to its support S. FIG. 5 shows a solution in which the two screws 24 are joined together by a spacer 240 and become inserted in two passages of the head 2. FIG. 6 shows another solution using a staple 25 that becomes inserted in two passages of the head 2. Of course, any other fixing element could be used.

The fixing means are thus produced in two non-parallel distinct transverse directions so as to be able to fix the head 2 to the support S using the two bearing planes thereof defined hereinabove. As the fixing elements can be inserted in each of the two senses of one and the same transverse direction, the head can thus be fixed to its support via four bearing planes, which are parallel in pairs. The four bearing planes run along the four lateral faces of the body of the switch. Once the head 2 is fixed to the support S, it is possible to remove the body 1 and rotate it with respect to the head 2, something which proves beneficial in orienting the output of an angled connector. Moreover, as described previously, fixing by the head 2 alone allows the design of the switch to become more rigid, stresses applied to the head 2 being absorbed not by its connection to the body 1 but by its firmer connection to the support S.

On mounting, the head 2 is first of all fixed to the support S by the fixing means, then the switching device 4 is fixed to the head (as depicted in FIG. 9). The switching device 4 is then wired up then covered by the body 1.

The solution whereby the limit switch is fixed via the head 2 makes the switch more robust while at the same time retaining the earlier advantages such as the option to give the head distinct orientations with respect to the object that is to be detected. Furthermore, once the head 2 is fixed, the body 1 can be disconnected from the head so that it can be replaced or reoriented with respect to the head 2.

The invention claimed is:

1. Limit switch comprising:

a body produced along a main axis and containing a switching device, a head that is removable and orientable with respect to the body so that it can adopt several distinct angular positions about the main axis, said head comprising actuating means arranged to act on the switching device, fixing means for fixing the limit switch to a support, characterized in that:

the fixing means are arranged only on the head of the limit switch, the head has at least two separate bearing planes, said fixing means being arranged to fix the head so that it bears against the support via one or other of its two bearing planes.

2. Limit switch according to claim 1, characterized in that the actuating means comprise an actuating member formed of a pivoting lever, of an axially moveable press rod or of a flexible stem.

3. Limit switch according to claim 1, characterized in that the head and the body comprise complementary positioning elements arranged to allow the head to adopt said several distinct angular positions with respect to the body.

4. Limit switch according to claim 1, characterized in that the switching device is fixed to the head.

5. Limit switch according to claim 1, characterized in that the fixing means comprise:

two first passages produced on the head in a first transverse direction and two second passages produced on the head in a second transverse direction, fixing elements arranged to become inserted in the two first passages so as to fix the head so that it bears against the support via its first bearing plane or so as to become inserted in the two second passages so as to fix the head so that it bears against the support via its second bearing plane.

6. Limit switch according to claim 5, characterized in that the first passages comprise grooves produced on the head at right angles to the main axis.

7. Limit switch according to claim 5, characterized in that the second passages comprise orifices produced on the head at right angles to the main axis.

8. Limit switch according to claims 5, characterized in that the fixing elements comprise a staple having two free ends each of which becomes inserted in one of the two first passages or in one of the two second passages.

9. Limit switch according to claim 5, characterized in that the fixing elements comprise two screws each of which becomes inserted in one of the two first passages or in one of the two second passages.

10. Limit switch according to claim 9, characterized in that the two screws are joined together by a spacer.

* * * * *